US009834404B2

(12) United States Patent
Castillo et al.

(10) Patent No.: US 9,834,404 B2
(45) Date of Patent: Dec. 5, 2017

(54) METHOD OF MAKING A DOWNHOLE SWELLABLE SEAL WITH A PASSAGEWAY THERETHROUGH

(71) Applicants: Robert O. Castillo, Stafford, TX (US); Gregory C. Badke, Houston, TX (US)

(72) Inventors: Robert O. Castillo, Stafford, TX (US); Darwin D. Arline, Houston, TX (US); Gregory C. Badke, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 946 days.

(21) Appl. No.: 13/927,793

(22) Filed: Jun. 26, 2013

(65) Prior Publication Data

US 2013/0283593 A1 Oct. 31, 2013

Related U.S. Application Data

(62) Division of application No. 13/617,111, filed on Sep. 14, 2012, now abandoned, which is a division of (Continued)

(51) Int. Cl.
*B65H 81/00* (2006.01)
*E21B 17/10* (2006.01)
(Continued)

(52) U.S. Cl.
CPC ..... *B65H 81/00* (2013.01); *E21B 17/1035* (2013.01); *E21B 33/1208* (2013.01); *E21B 33/1277* (2013.01); *Y10T 29/49826* (2015.01)

(58) Field of Classification Search
CPC ..... B29C 45/1671; B29L 2031/265; B65H 81/00; E21B 2033/005; E21B 33/1208;
(Continued)

(56) References Cited

U.S. PATENT DOCUMENTS 2,253,092 A 8/1941 Pranger
3,776,561 A * 12/1973 Haney ..... E21B 33/1208 277/340

(Continued)

FOREIGN PATENT DOCUMENTS

WO 20050090743 A1 9/2005

OTHER PUBLICATIONS

Al-Yami, A.S., et al. "Swelling Packers: Lab Testing and Field Application," International Petroleum Technology Conference, Kuala Lumpur, Malaysia, Dec. 3-5, 2008. Paper No. IPTC-11997-MS.

(Continued)

*Primary Examiner* — Jacob Cigna
(74) *Attorney, Agent, or Firm* — Cantor Colburn LLP

(57) ABSTRACT

A method of making a downhole swellable seal with a passageway therethrough includes, perimetrically surrounding a first tubular with a first substantially nonswellable material, perimetrically surrounding at least one second tubular with a second substantially nonswellable material, positioning the at least one second tubular adjacent the first tubular, perimetrically surrounding the first tubular and the at least one second tubular with a swellable material, curing the first substantially nonswellable material, curing the second substantially nonswellable material, and curing the swellable material.

10 Claims, 5 Drawing Sheets

Related U.S. Application Data application No. 12/402,667, filed on Mar. 12, 2009, now abandoned.

(51) Int. Cl.
*E21B 33/127* (2006.01)
*E21B 33/12* (2006.01)

(58) Field of Classification Search
CPC ..... E21B 33/127; E21B 17/1035; E21B 33/1277; E21B 17/003; E21B 33/128; Y10T 29/49826; F16C 1/06; B25D 2250/365; E21D 23/0463
USPC ..... 173/210, 184–189, 150, 213, 1, 170
See application file for complete search history.

(56) References Cited

U.S. PATENT DOCUMENTS 3,899,631 A * 8/1975 Clark ..... E21B 17/003 166/187
4,042,023 A * 8/1977 Fox ..... E21B 17/1035 166/241.7
4,967,846 A * 11/1990 Wood ..... F16J 15/46 166/187
5,426,264 A * 6/1995 Livingston ..... H01B 7/046 174/102 R
6,173,788 B1 1/2001 Lembcke et al.
6,241,022 B1 * 6/2001 Mailand ..... E21B 17/025 166/242.6
6,325,144 B1 12/2001 Turley et al.
6,761,222 B2 7/2004 Wilson
7,264,061 B2 9/2007 Dybevik et al.
7,762,322 B2 7/2010 Andersen et al.
7,836,960 B2 * 11/2010 Patel ..... E21B 17/1035 166/118
2007/0012436 A1 * 1/2007 Freyer ..... E21B 17/003 166/179
2007/0158060 A1 * 7/2007 Baaijens ..... E21B 17/1035 166/65.1
2008/0185158 A1 * 8/2008 Chalker ..... E21B 33/1208 166/387
2009/0173505 A1 * 7/2009 Patel ..... E21B 17/1035 166/385
2009/0211770 A1 * 8/2009 Nutley ..... E21B 33/1208 166/387
2009/0229816 A1 * 9/2009 Lemme ..... B29C 45/1671 166/179
2009/0250228 A1 * 10/2009 Loretz ..... E21B 33/12 166/387
2009/0277652 A1 * 11/2009 Nutley ..... E21B 17/003 166/387
2009/0283254 A1 * 11/2009 Andersen ..... E21B 17/023 166/118
2010/0230094 A1 * 9/2010 Foster ..... E21B 33/1208 166/179
2011/0056706 A1 * 3/2011 Brooks ..... E21B 17/105 166/387
2012/0031607 A1 * 2/2012 Lahijani ..... C08L 27/18 166/65.1
2014/0262210 A1 * 9/2014 Doweidt ..... E21B 33/1208 166/179

OTHER PUBLICATIONS

Hembling, D., et al. "Swell Packer: Enabling Openhole Intelligent and Multilateral Well Completion for Enhanced Oil Recovery," IADC/SPE Asia Pacific Drilling Technology Conference and Exhibition, Bangkok, Thailand, Nov. 13-15, 2006. Paper No. 100824-MS.

Hertfelder, G., et al. "Are Swelling-Elastomer Technology, Preperforated Liner; and Intelligent-Well Technology Suitable Alternatives to Conventional Completion Architecture?" SPE/IADC Drilling Conference, Amsterdam, The Netherlands, Feb. 20-22, 2007. Paper No. 105443-MS.

Kennedy, G., et al. "The Use of Swell Packer's as a Replacement and Alternative to Cementing," SPE Annual Technical Conference and Exhibition, Dallas, Texas, Oct. 9-12, 2005. Paper No. 95713-MS.

International Search Report and the Written Opinion of the International Searching Authority, PCT/US2010/026995; dated Sep. 30, 2010; 7 pages.

* cited by examiner

METHOD OF MAKING A DOWNHOLE SWELLABLE SEAL WITH A PASSAGEWAY THERETHROUGH

CROSS-REFERENCE TO RELATED APPLICATION

This application is a divisional application of U.S. patent application Ser. No. 13/617,111 filed Sep. 14, 2012, which is a divisional application of U.S. patent application Ser. No. 12/402,667, filed Mar. 12, 2009, now abandoned, the entire contents of which are incorporated herein by reference.

BACKGROUND

It is common in the hydrocarbon recovery industry to have a need to plug an annular space defined by a tubular and a downhole wellbore structure, such as, a liner, casing or open hole, for example, within which the tubular is positioned. One sealing method includes positioning a swellable member perimetrically about the tubular prior to positioning the tubular within the downhole structure. The swellable member swells in response to exposure to downhole fluids such as oil or water for example. The swelling of the swellable member causes the swellable member to fill the annular space and to sealingly engage with walls of both the tubular and the downhole structure.

Establishing and maintaining a well secured communication from one side of the swellable seal to the other can be useful in well operations. Unsecured communication lines can have a far greater operational cost, which may result in having to exit from the borehole in order to make further securing repairs. Excessive vibration caused by one tool traveling down the borehole may adversely affect the performance of other tools obtaining valuable downhole data. That vibration creation along with unsecure communication lines may only amplify false results. Such amplification from those unsecure lines would be in comparison to a tuning fork when strike. In most gamma ray equipped downhole tools, the smooth transition of multiple or single photo multiplier tubes are important in order to provide the necessary pulse of light via the tubes. Any sharp bends or vibration may only destroy this very important light communication. Another example is on a telemetry downhole tool, mud pulses are registered by these types of tools via an electrical sensor. Any additional impacts from unsecured communication lines will only amplify noises or even provide false readings that are important to this data gathering. Systems and methods, therefore, that permit sealing and maintaining a solid lock down in an annular space while maintaining a communication passageway across the seal are desirable in the art.

BRIEF DESCRIPTION

Disclosed herein is a downhole sealing device. The device includes, a swellable member, and a passageway having a perimetrically continuous wall. The swellable member is configured to cause sealing between a downhole structure and a plurality of tubulars when in a swelled condition, the plurality of tubulars are routed through a plurality of voids extending longitudinally through the swellable member, each of the plurality of voids has perimetrically continuous walls surrounding each of the plurality of tubulars.

Further disclosed herein is a downhole swellable sealing system with passageway. The system includes, at least one substantially nonswellable member, and a swellable member in operable communication with the at least one substantially nonswellable member. The swellable member is configured to cause sealing between a downhole structure and a plurality of tubulars when in a swelled condition, the plurality of tubulars are routed through a plurality of voids that extend longitudinally through at least one of the swellable member and the at least one substantially nonswellable member, and each of the plurality of voids has perimetrically continuous walls surrounding each of the plurality of tubulars.

Further disclosed herein is a method of making a downhole swellable seal with a passageway therethrough. The method includes, perimetrically surrounding a first tubular with a first substantially nonswellable material, perimetrically surrounding at least one second tubular with a second substantially nonswellable material, positioning the at least one second tubular adjacent the first tubular, perimetrically surrounding the first tubular and the at least one second tubular with a swellable material, curing the first substantially nonswellable material, curing the second substantially nonswellable material, and curing the swellable material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
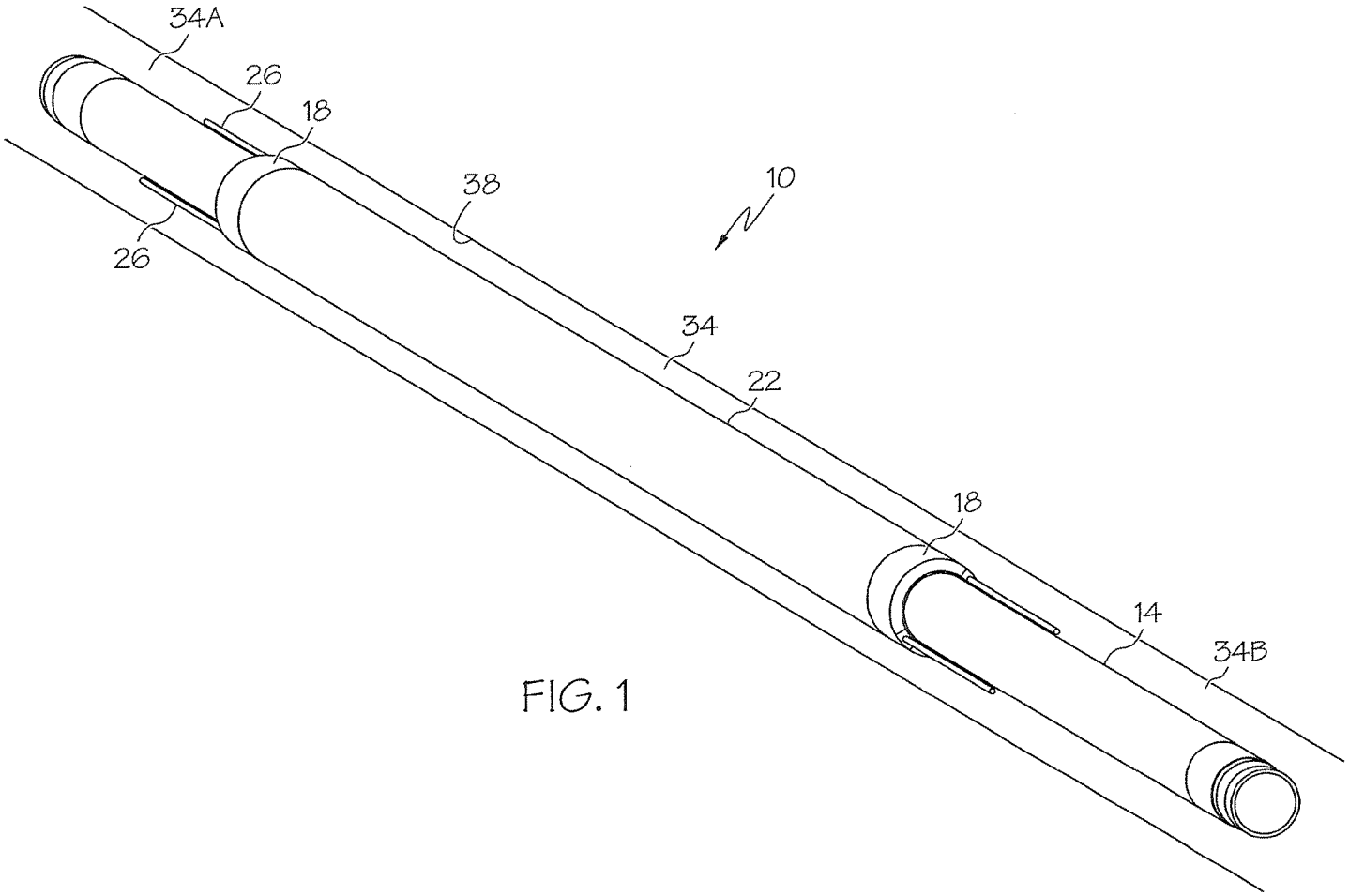
FIG. 1 depicts a perspective view of a downhole swellable sealing system with passageway as disclosed herein.
Figure 2:
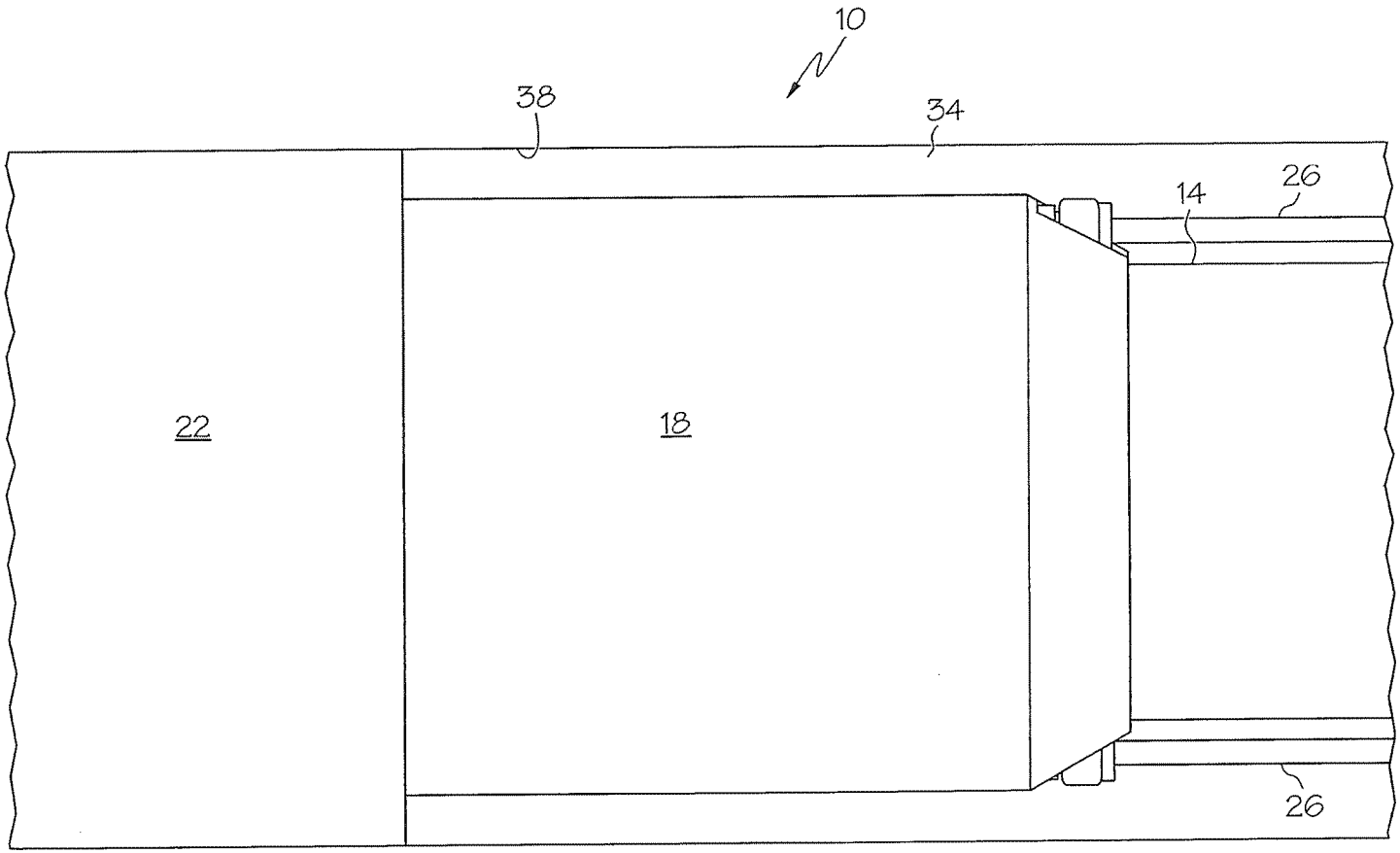
FIG. 2 depicts a magnified side view of a portion of the downhole swellable sealing system of FIG. 1.

Referring to FIGS. 1 and 2, an embodiment of the swellable sealing system 10 with passageway disclosed herein is illustrated. The swellable sealing system 10 includes, a substantially nonswellable member 18, a swellable member 22, and at least one void 28 with a perimetrically continuous wall extending longitudinally through at least one of the substantially nonswellable member 18 and the swellable member 22. The substantially nonswellable member 18 perimetrically surrounds a first tubular 14 and at least one second tubular 26 is positioned within the void 28. The second tubular 26 is preferably constructed of a rigid material such as stainless steel, for example, and has an inner cavity defining a passageway 30 (as best illustrated in the cross sectioned views in FIGS. 3 and 5). The swellable sealing system 10 is configured to seal an annular space 34 defined in this embodiment by the first tubular 14 and a downhole structure 38 that the system 10 is positioned substantially concentric with, such as, a liner, casing or open hole, for example, while providing the passageway 30 therethrough, via the second tubular 26. It should be noted that alternate embodiments could be configured to seal an annular space that is defined radially inwardly of the first tubular 14 and radially outwardly of a downhole structure positionable within at least a portion of the first tubular. The passageway fluidically connects a portion of the annular space 34A beyond one longitudinal end of the nonswellable member 18 to a portion of the annular space 34B beyond an opposite longitudinal end of the nonswellable member 18. The passageway 30 can be used as a control line directly with hydraulic fluid being ported therethrough, for example, or as a conduit for running a separate control line (not shown), such as, electric line or fiber optic cable, for example.

The swellable member 22 may be constructed of any swellable material known in the industry such as polymers that swell when exposed to conditions commonly encountered downhole such as oil or water, for example. In contrast, the nonswellable member 18 may be constructed of known materials that tend to be substantially nonswellable when exposed to the same downhole conditions mentioned above.

Figure 3:
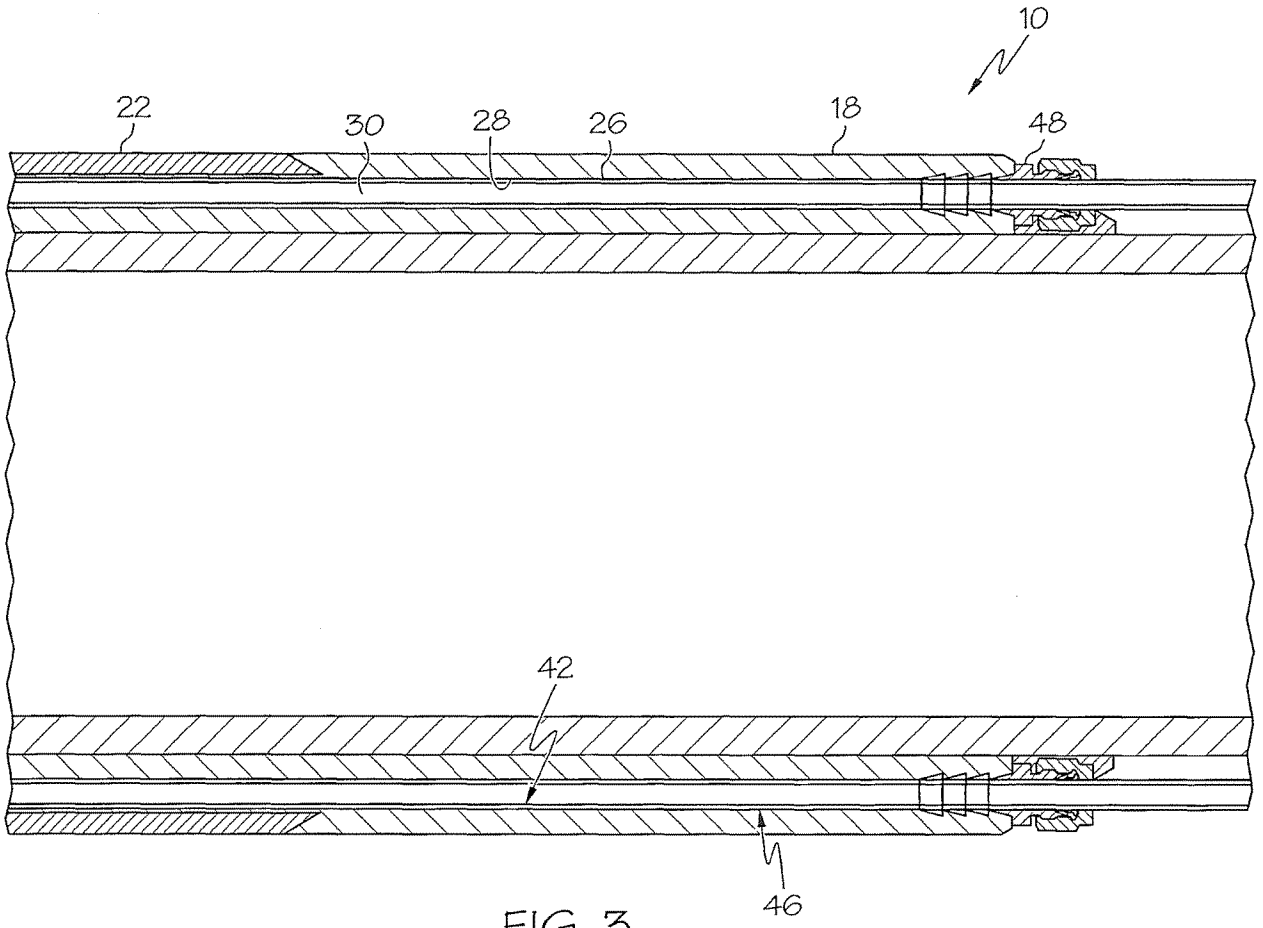
FIG. 3 depicts a cross sectional side view of an embodiment of the swellable sealing system of FIG. 2.

Referring to FIG. 3, the perimetrically continuous void 28 extends longitudinally through the nonswellable member 18. Since walls 42 of the void 28 are continuous they have no perimetrical interruptions, such as a longitudinal slit through the nonswellable member 18, for example, and are therefore easily sealed to an outer radial surface 46 of the second tubular 26. Optionally, a mechanical device 48 can be sealably attached to both the second tubular 26 and the nonswellable member 18 at both ends where the second tubular 26 exits from the nonswellable member 18 thereby preventing any movement between the second tubular 26 and the nonswellable member 18. Additionally, by making the mechanical device 48 metal the seal between the second tubular 26 and the mechanical device can be a metal-to-metal seal. Embodiments of processes to make the swellable sealing system 10 and particularly the perimetrically continuous void 28 will be described below.

Figure 4:
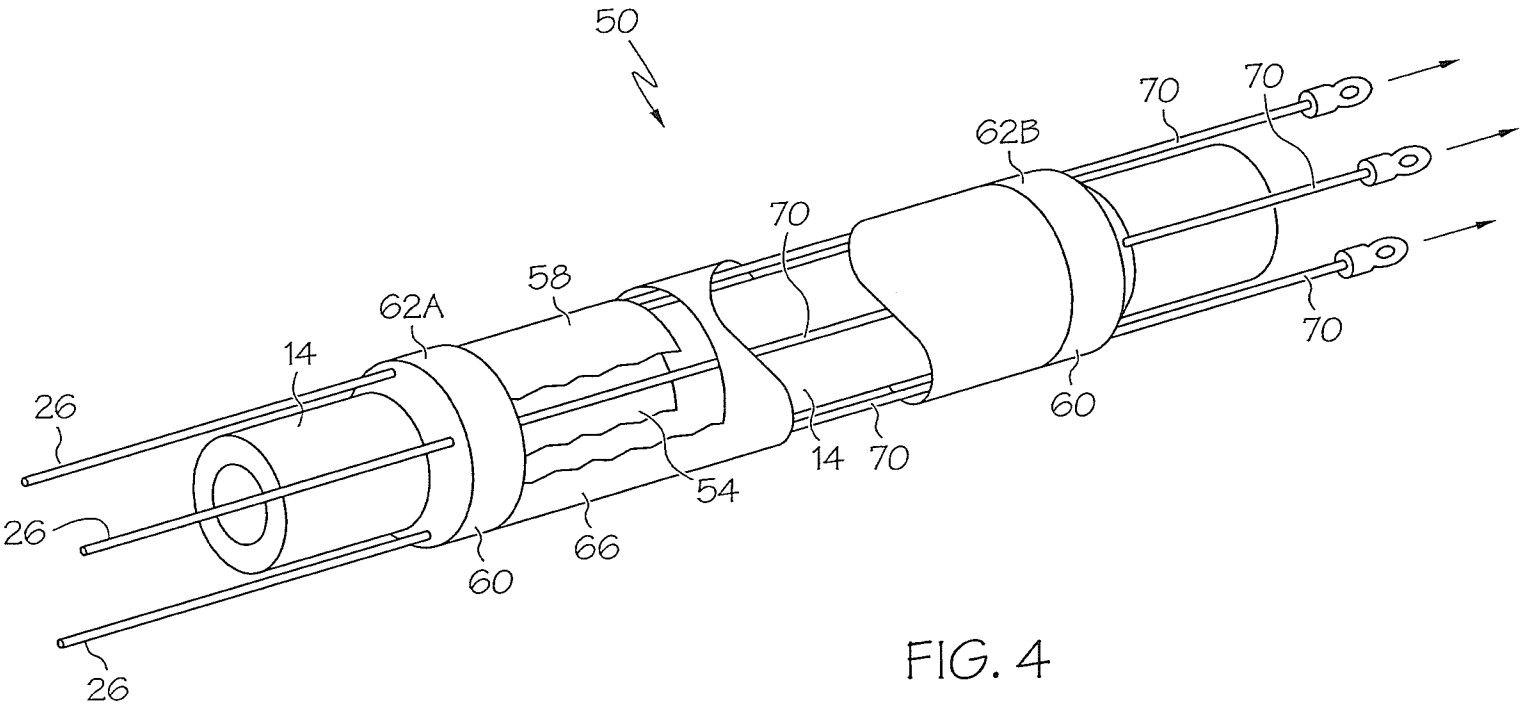
FIG. 4 depicts a perspective view of the swellable sealing system of FIG. 1 during a forming operation of perimetrically continuous voids.

Referring to FIG. 4, an embodiment of a process to make the swellable sealing system 10 is illustrated generally at 50. A first nonswellable material 54 is wrapped perimetrically around the first tubular 14. At least one second tubular 26 is positioned substantially parallel to the first tubular 14 and a second nonswellable material 58 is wrapped around both the first tubular 14 and the second tubular 26. Wrapping additional layers of a third nonswellable material 60 around both the first tubular 14 and the second tubular 26 forms a first dam 62A and a second dam 62B. Nylon (not shown) or other material capable of holding the nonswellable materials 54, 58 and 60 in position while being heated to curing temperatures is wrapped around all of the nonswellable materials 54, 58 and 60. The full assembly is heated to cure the nonswellable materials 54, 58 and 60. After curing, the nylon is removed and a swellable material 66 is wrapped perimetrically around the nonswellable materials 54, 58 between the dams 62A and 62B. Nylon or other material is then wrapped around the swellable material 66 and the full assembly is again heated, this time to cure the swellable material 66. The nylon is removed after curing.

Optionally, the step of wrapping the second tubular 26 with the nonswellable material 58, could be replaced with wrapping a rod 70 (or other reusable manufacturing tubular). This may be desirable to avoid oxidation and possible contamination of the passageway 30 of the second tubular 26 that could occur during manufacture or during the high temperature curing processes. If the rod 70 were used it would be employed to form the perimetrically uninterrupted longitudinal void 28 in the nonswellable material 58. Doing so, however, would require withdrawal of the rod 70 upon completion of the last curing cycle. Application of a release agent, such as, mold release, for example, to the rod 70 prior to it being wrapped in the nonswellable material 58 could facilitate its withdrawal upon completion of the curing process. A step of inserting the second tubular 26 into the void 28 could be done in conjunction with the withdrawal of the rod 70, by attaching and end of the second tubular 26 to an end of the rod 70. The action of withdrawing the rod 70 would then also insert the second tubular 26 into the void 28.

Figure 5:
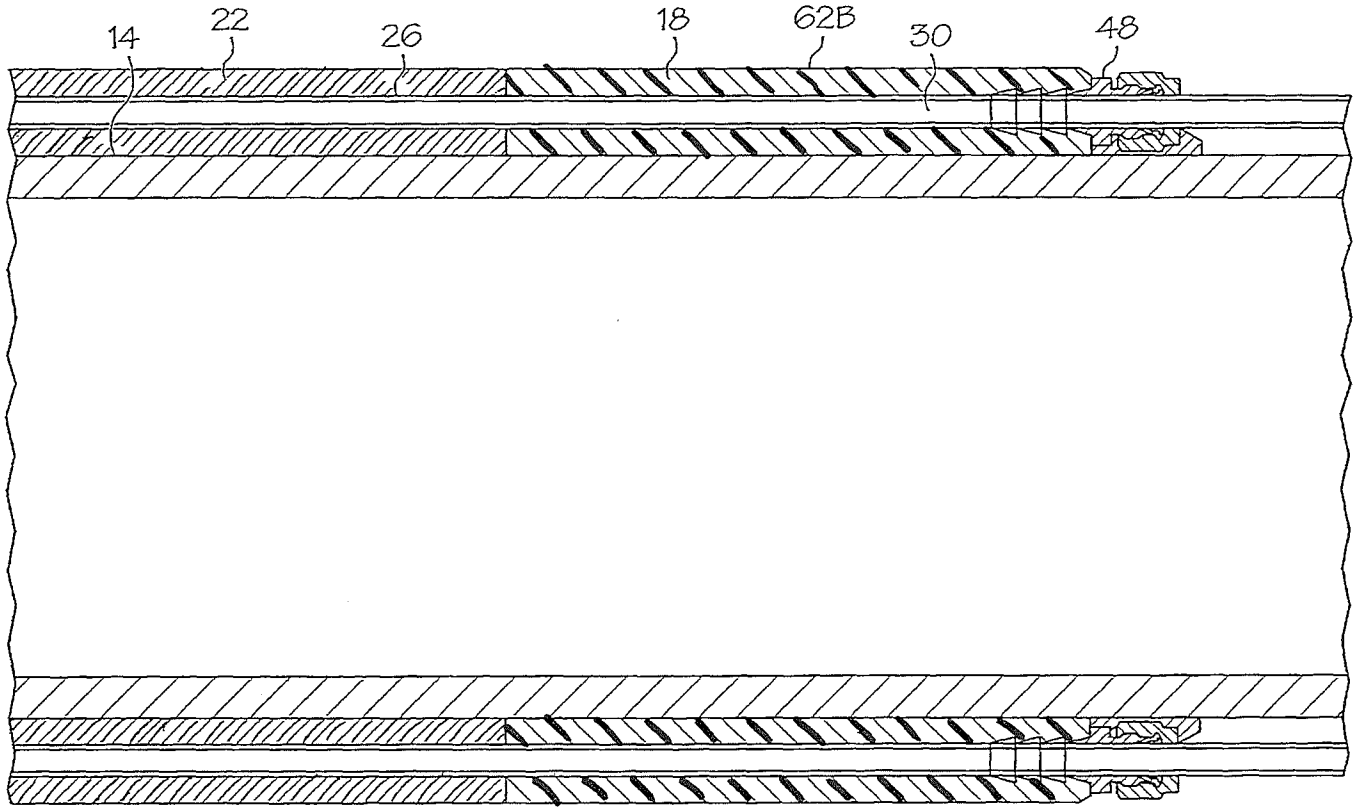
FIG. 5 depicts a cross sectional side view of an alternate embodiment of the swellable sealing system of FIG. 2.

Referring to FIG. 5, optionally, the nonswellable materials 54, 58, 60 could be wrapped only at the dams 62A and 62B. In such case, the swellable material 66 would be wrapped directly over the first tubular 14 and the second tubular 26 (or rods 70) between the dams 62A and 62B as desired by a well operator.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A method of making a downhole swellable seal with a passageway therethrough, comprising:

perimetrically surrounding a first tubular with a first substantially nonswellable material;

perimetrically surrounding at least one second tubular with a second substantially nonswellable material;

positioning the at least one second tubular adjacent the first tubular;

perimetrically surrounding the first tubular and the at least one second tubular with a swellable material;

curing the first substantially nonswellable material arranged on the first tubular;

curing the second substantially nonswellable material arranged on the second tubular; and curing the swellable material.

2. The method of making the downhole swellable seal with a passageway therethrough of claim 1, further comprising:

withdrawing the at least one second tubular from the second substantially nonswellable material;

leaving a void with perimetrically continuous walls in the second substantially nonswellable material; and inserting a third tubular into the void.

3. The method of making the downhole swellable seal with a passageway therethrough of claim 2, further comprising connecting the third tubular to the at least one second tubular prior to withdrawing the at least one second tubular.

4. The method of making the downhole swellable seal with a passageway therethrough of claim 1, further comprising sealing the first tubular to the first substantially nonswellable material and sealing the at least one second tubular to the second substantially nonswellable material.

5. The method of making the downhole swellable seal with a passageway therethrough of claim 1, further comprising applying a release agent to the at least one second tubular prior to the surrounding with substantially nonswellable material.

6. The method of making the downhole swellable seal with a passageway therethrough of claim 1, further comprising damming the swellable material with at least one of the substantially nonswellable materials.

7. The method of making the downhole swellable seal with a passageway therethrough of claim 6, further comprising sealably attaching a mechanical device to the at least one second tubular and to the substantially nonswellable material that is damming the swellable material.

8. The method of making the downhole swellable seal with a passageway therethrough of claim 7, wherein the sealably attaching of the mechanical device to the at least one second tubular is a metal-to-metal seal.

9. The method of making the downhole swellable seal with a passageway therethrough of claim 7, wherein the sealably attaching includes immobilizing the at least one second tubular with respect to the substantially nonswellable material that is damming the swellable material.

10. The method of making the downhole swellable seal with a passageway therethrough of claim 1, further comprising perimetrically surrounding at least one of the first substantially nonswellable material and the second substantially nonswellable material with the swellable material.

* * * * *